US005662242A

United States Patent [19]

Steo

[11] Patent Number: 5,662,242

[45] Date of Patent: Sep. 2, 1997

[54] ANTI-DROP PAINT CAN DEVICE

[76] Inventor: Raymond Steo, 610 S. Clinton St., Denver, Colo. 80231

[21] Appl. No.: 335,360

[22] Filed: Nov. 3, 1994

[51] Int. Cl.[6] ..... B65D 25/00

[52] U.S. Cl. ..... 220/695; 220/700

[58] Field of Search ..... 220/685, 690, 220/700

[56] References Cited

U.S. PATENT DOCUMENTS

| | | | |
|---|---|---|---|
| 3,298,561 | 1/1967 | McConnie | 220/695 |
| 3,329,307 | 7/1967 | Jacobson | 220/695 |
| 3,945,527 | 3/1976 | Pylant | 220/695 X |
| 4,020,968 | 5/1977 | Chiavola et al. | 220/700 X |
| 4,225,064 | 9/1980 | Westcott | 220/695 X |
| 4,312,459 | 1/1982 | Leach | 220/700 X |
| 4,893,723 | 1/1990 | Seabolt | 220/695 X |

*Primary Examiner*—Steven M. Pollard
*Attorney, Agent, or Firm*—Joseph C. Herrig & Assoc.

[57] ABSTRACT

A protector against filling the channeled rim of a paint type can is made of a flexible material. It has a concave top which conforms to the shape of the top of the can and fits snugly over the can rim. It also has a centered, preferably elongated hole. The inner bottom edge of the outer leg of the channel has a projection which slips over the bead at the top outer edge of the can and remains below the bead during use.

5 Claims, 3 Drawing Sheets

ANTI-DROP PAINT CAN DEVICE

BACKGROUND OF THE INVENTION

There has been and is a need for a device which can be fitted over open paint cans and will prevent the grooves for the paint lid from filling with paint during the painting process.

One such device has a downward facing "C" channel, with 180 degree arc. The channel fits over one half the can rim. On one end, the bottom outer edge of the channel has a flattened lateral projection and near the other end a slot within a lateral projection. These are apparently helpful for removing the device from the can prior to closing the can.

The outer edge of the upper surface of the channel has three slots, two adjacent the ends of the arc and one centered. Under each slot are projections from the side wall and a inner slot, bottom surface for engaging the top outer edge of the paint can. The inner bottom surface of the channel extends inwardly across the arc and is serrated for stripping the paint from the brush during the painting process. At one end of the extension a slot is cut to hold a stirrer. If paint is to be poured, it is poured from the unprotected side of the can.

Another device manufactured by the Aqua-Tainer Company of Joliet, Ill., U.S.A., 60433 combines a hinged, closure with a round fitting. The fitting has a 360 degree downwardly facing "C" channel which fits over the inner and outer edges of the paint can rim. A tab extends from one side of the fitting to enable the device to be removed from the can. On the upper surface of the channel, one half of a female hinge extends vertically. A thin vertical projection extends primarily from the inner, upper surface of the channel laterally to the outer edge of the channel to create an ovoid shape on the side opposite the hinge and to form an enclosure.

Another thin vertical projection effectively bisects the walls of the ovid along a line perpendicular to the small end of the ovoid. This area between the bisecting projection and the smaller end of the ovoid has two vertical projections running from the vertical bisecting projection to the ovoid edge thereby creating a central opening for pouring, these are flanked by stiffening bottom closures which have a hole in each to allow any slopped paint to flow into the can. A top closure is moulded with a male hinge half and recesses complimentary to the vertical projections described to form a complimentarily formed cap or closure.

Both these devices are complex and often difficult to clean because of their complexity. The units of this invention are simpler and equal to or more effective than the prior art devices.

SUMMARY OF THE INVENTION

A protector of the rims of paint cans allows a brush to be dipped into the can and excess paint to be stripped from the brush while keeping the can rim paint free. The protector is made up of a can top, usually of plastic, with a central elongated hole. The can top has an outer ridge of the size of the open can top and a central shallow, flat to slightly concave surface in which there is positioned an elongated more steeply depressed hole with reinforced edges. The edges may be smooth or may have saw-toothed, sinusoidal, etc. edges.

DETAILED DESCRIPTION OF THE FIGURES

The numerals of the various models remain the same from figure to figure. Variations of an element will have an additional letter or designator.

Figure 1:
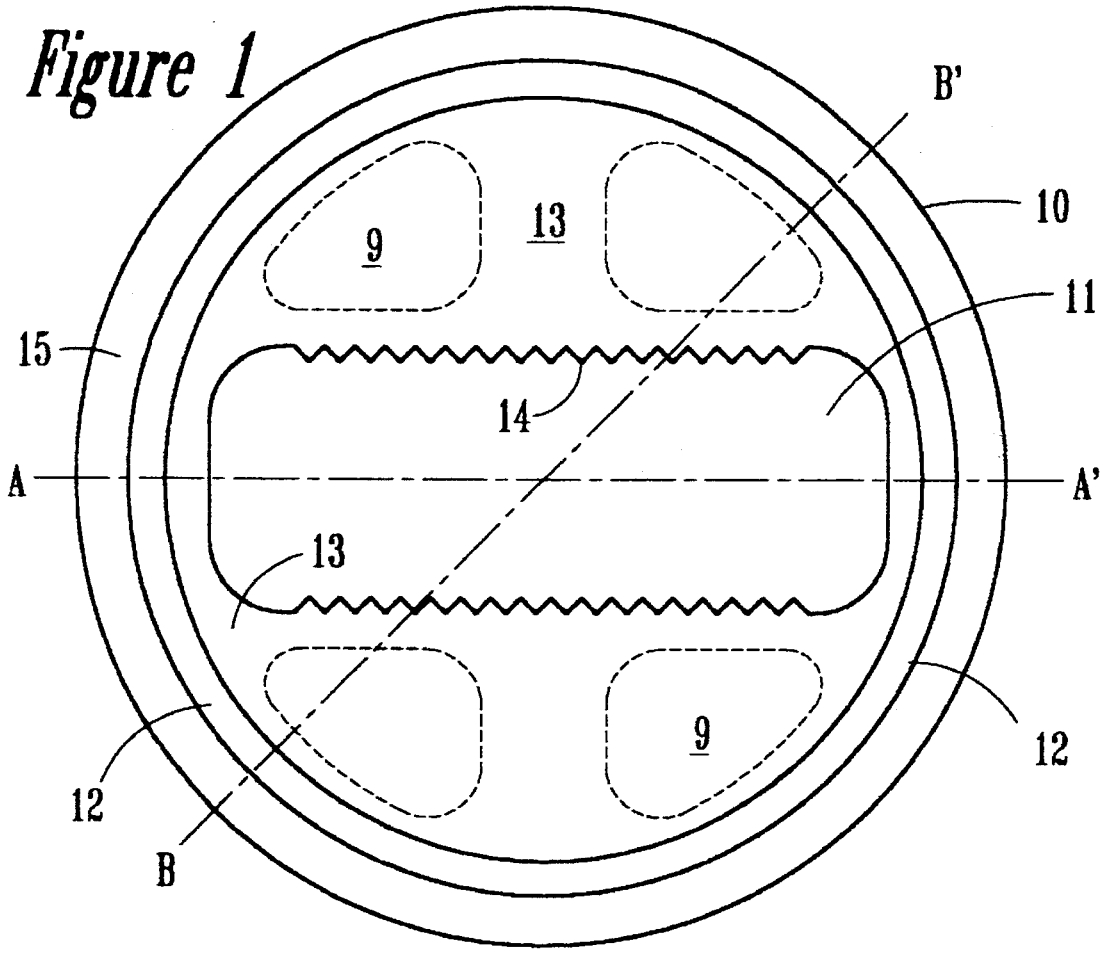
FIG. 1 is a top view of a preferred model

FIG. 1 shows a top view of a protector for can tops.

The protector has a generally concave top having a circular outer periphery with unreinforced areas 9. The top has a depending flange 10 and a rectangular opening 11. Edge reinforcement 12 continues into reinforcement 13 surrounding opening 11. The opening 11 has serrated teeth 14 to assist in the stripping of excess paint from a brush which has been dipped in the fluid within the can. A shoulder 15 is used to help retain any sloshed fluid.

Figure 2:
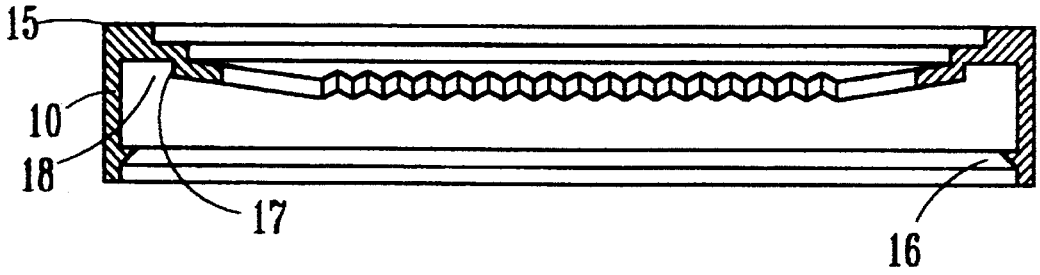
FIG. 2 is a section of the model of FIG. 1 taken through A—A'

FIG. 2 is a section through A—A' of FIG. 1. This figure shows the generally concave shape of the protecter as it extends inwardly from shoulder 15. Shoulder 15 is preferably squared off. Flange 10 has an inner retaining lip 16 which slips over the head of the can top and maintains a snug seal between the protector and the can when in place. Projection 17 creates a channel into a can top of predetermined size fits snugly to provide an attachment.

Figure 3:
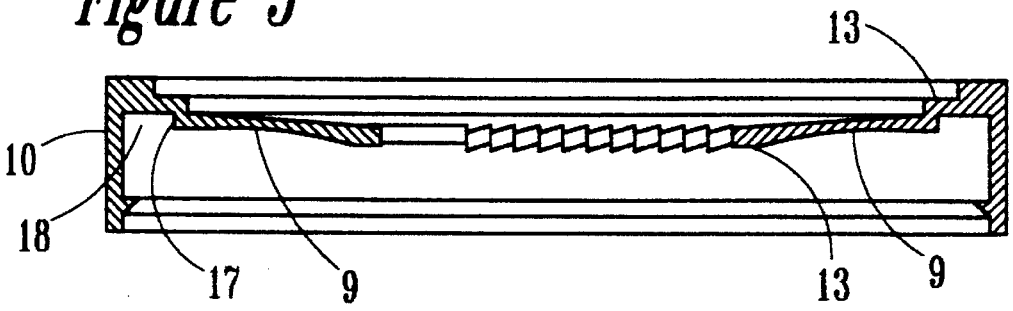
FIG. 3 is a section of the model of FIG. 1 taken through B—B'

FIG. 3 profiles the protector FIG. 1 via section B—B' additionally showing the unreinforced area 18.

Figure 4:
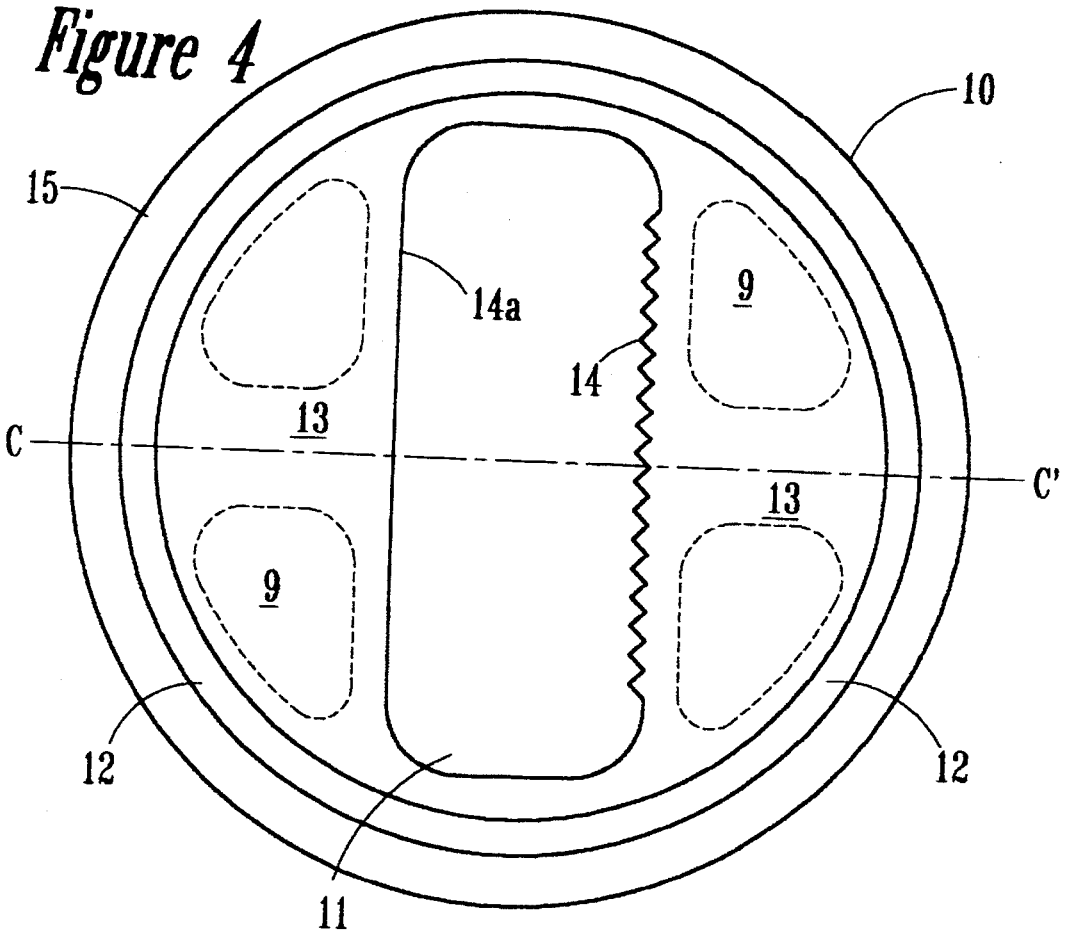
FIG. 4 is a top view of a second preferred model

FIG. 4 depicts a variation on the design of FIG. 1 wherein one side 14*a* of opening 11 is non serrated.

Figure 5:
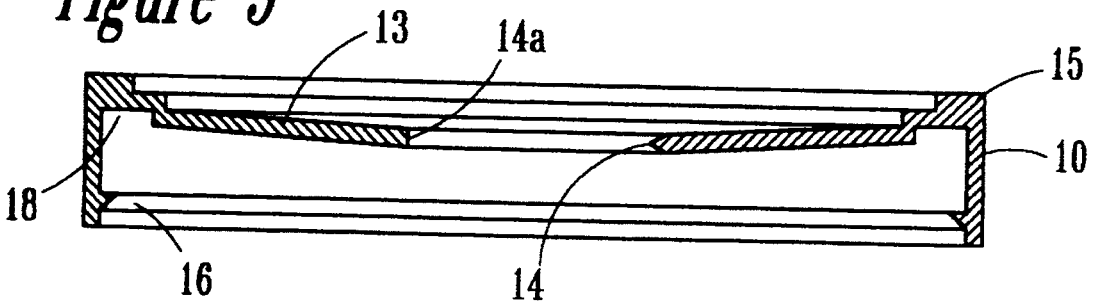
FIG. 5 is a section of the model of FIG. 4 through C—C'

FIG. 5 is a section through C—C' of FIG. 4 embodiment.

Figure 6:
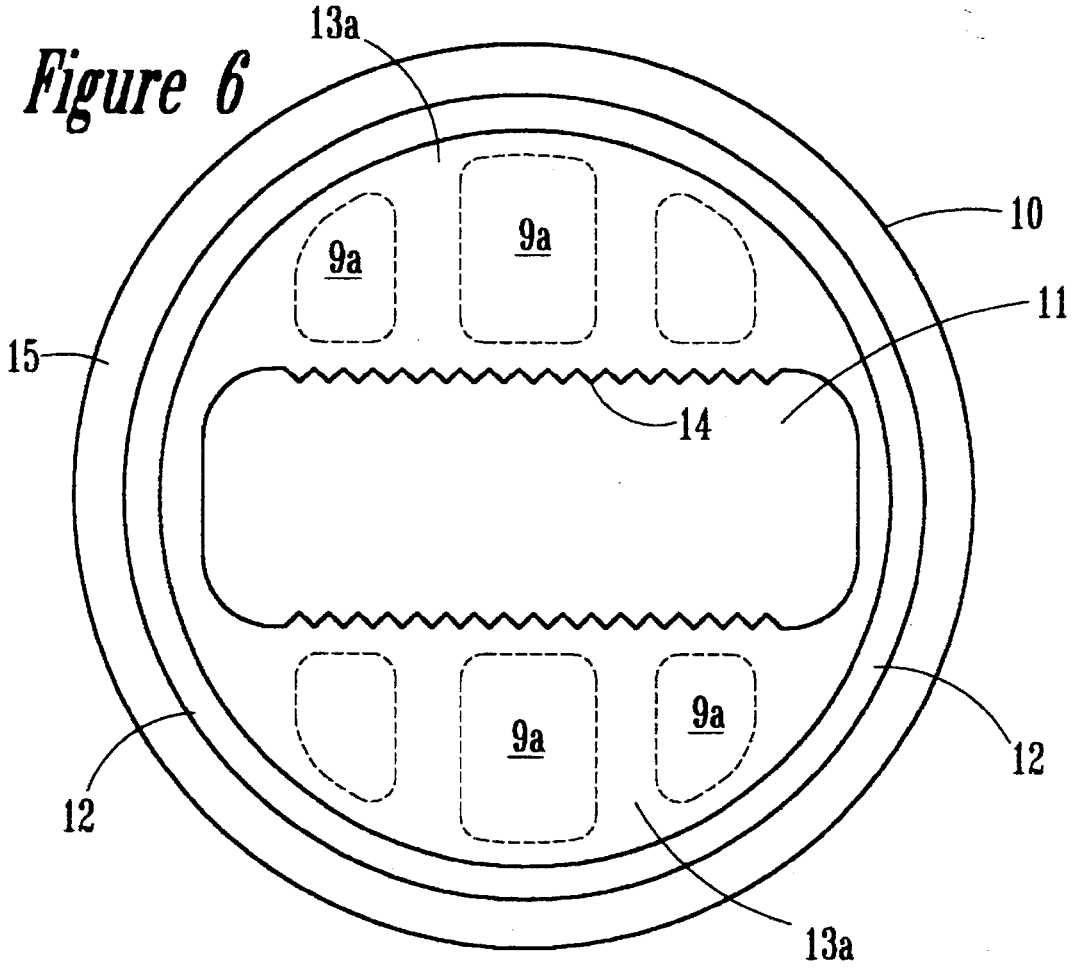
FIG. 6 is a top view of a third preferred model.

FIG. 6 is configured so that the reinforcement 13*a* is a "pillared" configuration and the unreinforced portion 9*a* is appropriately repositioned.

The protective devices are preferably made of a flexible resilient plastic but can be made of an elastomeric material having similar properties. The plastic and elastomeric material can be made of, for example, polyhydrocarbons such as polyethylene; polyhalon carbons such as polyvinyl chloride; and stiff silicone and hydrocarbon, etc. rubbers. Protective devices of the general configuration and made of materials similar to be slightly stiffer than the flexible tops used to reseal coffee, etc., cans are preferred. Flexible, springy metals can be used where the depending flange is slitted to compensate for a lack of any "stretching" capability.

The overall configuration of the rim of the protective devices will be that of the can to be protected, i.e., generally round, square or rectangular with rounded edges.

The devices can be used with cans containing any type of fluid which is to be brushed on a surface, e.g., paint, stain, waterproofing, other sealants, etc.

The reinforced areas of the top are thicker than the unreinforced portion of the protector and can be defined sharply or the reinforced and unreinforced areas can gradually taper into each other. The reinforcement can be as shown or any other desired effective configuration. The amount of the reinforcement needed will depend on the viscosity of the liquid in the can or bucket.

The width of the depending flange 10 and the projection 17 and the depth of the channel 18 will also be influenced by the viscosity of the liquid in the can. High viscosity liquids will require more pressure to be exerted upwardly against the edges of the opening and this pressure will tend to unseat the protector. Therefore, the protector is preferably designed with the liquid viscosity in mind. The channels should be deeper and the grip by the channel on the sides of the can top will be greater where fluid viscosity is higher than normal.

The openings in the protectors should be as wide as possible, e.g., the opening of a protector sized for a one gallon can should be sufficiently wide that the user has no problems when using a four inch brush.

Serrations can be on one or both of the sides and ends of the opening for brush insertion depending on user preference.

Now having described my invention, what I claim is:

1. A flexible protector for reducing paint flow onto the sides and into the grooves of the top of a paint type can comprising a generally concave top having a circular periphery and having an elongated, substantially rectangular, opening intermediate its sides, sized for insertion of a brush into paint within the can and for stripping excess paint from the brush when withdrawing the brush from the paint, at least one area of reinforcement supporting the elongated opening.

a rim on the outer edge of the top with a shoulder for containing any outward flow of minor amounts of paint and a depending flange of a width sufficient to fit over the outer, upper edge of a paint can of predetermined size a projection means encircling the inner side of the flange for gripping adjacent its upper edge.

2. The device of claim 1 wherein at least one of a side and end of the elongated opening has a serrated edge.

3. The device of claim 1 wherein the shoulder has a substantially vertical inner surface.

4. The device of claim 1 wherein at least one area of the concave top substantially perpendicular to the elongated opening is reinforced.

5. The device of claim 1 wherein the reinforcement is on the lower surface of the concave top.

* * * * *